United States Patent [19]

Taylor

[11] 4,404,914

[45] Sep. 20, 1983

[54] DRAWING TABLE AND EASEL CONVERSION

[76] Inventor: Max F. Taylor, Rte. 1, Bradley Rd., Whitewater, Wis. 53190

[21] Appl. No.: 294,669

[22] Filed: Aug. 20, 1981

[51] Int. Cl.[3] ..... A47F 5/12

[52] U.S. Cl. ..... 108/9; 248/449

[58] Field of Search ..... 108/1, 4, 9, 10, 13, 108/90; 248/449

[56] References Cited

U.S. PATENT DOCUMENTS

| | | | |
|---|---|---|---|
| 492,940 | 3/1893 | Mauchain . | |
| 511,466 | 12/1893 | Selden . | |
| 519,655 | 5/1894 | Atzert . | |
| 677,216 | 6/1901 | Huebner . | |
| 697,639 | 5/1902 | Lindner . | |
| 785,147 | 3/1905 | Barnett . | |
| 874,052 | 12/1907 | Cantwell | 108/4 |
| 879,620 | 2/1908 | Forsyth | 108/10 |
| 1,652,774 | 12/1927 | Fraser et al. . | |
| 1,942,603 | 1/1934 | Johanson | 108/9 X |
| 2,032,872 | 3/1936 | Friedrichs | 248/449 |
| 2,134,810 | 11/1938 | Boyle | 248/449 |
| 2,215,462 | 9/1940 | Davidson, Jr. et al. | 108/10 X |
| 2,265,105 | 12/1941 | Farrington . | |
| 3,006,107 | 10/1961 | Tolegian | 248/449 |
| 3,094,948 | 6/1963 | Clow | 108/10 |
| 3,095,834 | 7/1963 | Killen | 248/449 X |
| 3,150,615 | 9/1964 | Beijer | 108/9 |
| 3,244,465 | 4/1966 | Ulrich, Jr. et al. . | |
| 3,495,552 | 2/1970 | Dietrick . | |
| 4,196,674 | 4/1980 | Van Laarhoven . | |

*Primary Examiner*—Ramon S. Britts
*Assistant Examiner*—Peter A. Aschenbrenner
*Attorney, Agent, or Firm*—Wheeler, House, Fuller Hohenfeldt

[57] ABSTRACT

A collapsible drawing table which also can be used as an easel, having a tabletop which can be inclined horizontally, vertically, or obliquely.

In an alternate embodiment of the invention a separate easel body is provided for the assembly. The easel body can be skeletonized and can have vertically adjustable keeper and ledge means to allow the effective height of the easel to be varied without moving its frame.

The invention is especially adapted for use by those who need both an easel and a tiltable folding table but have room for only one such appliance.

15 Claims, 12 Drawing Figures

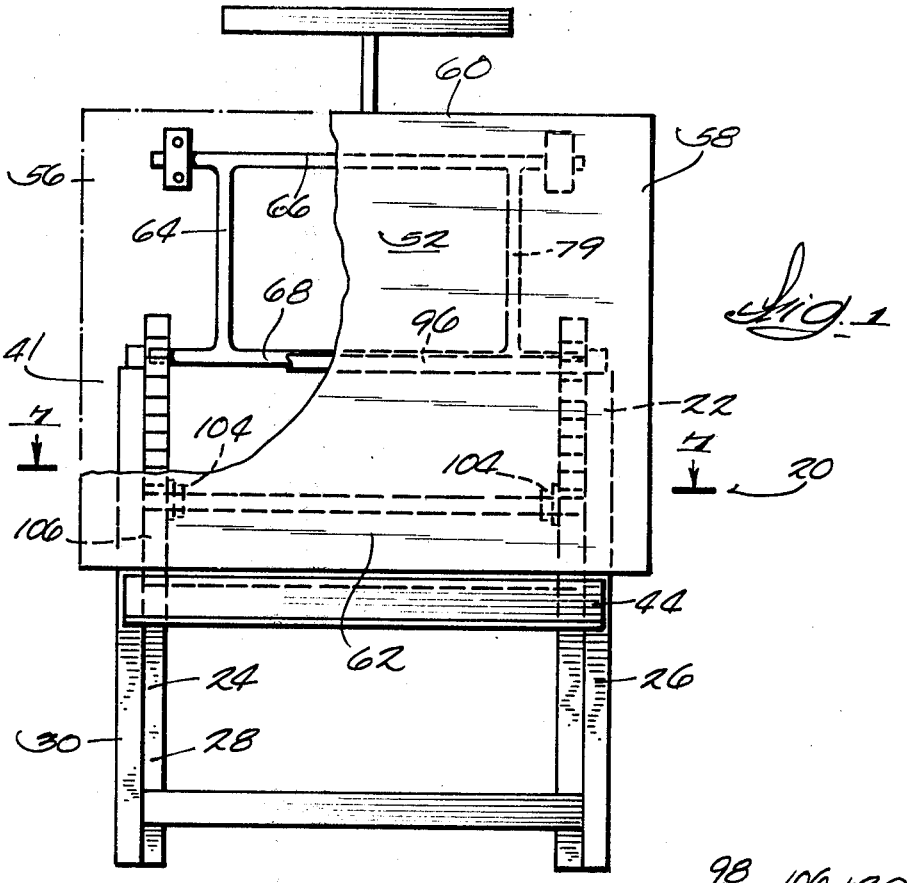
Fig. 1
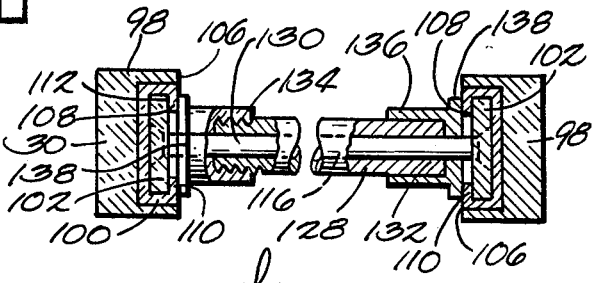
Fig. 7
Fig. 5
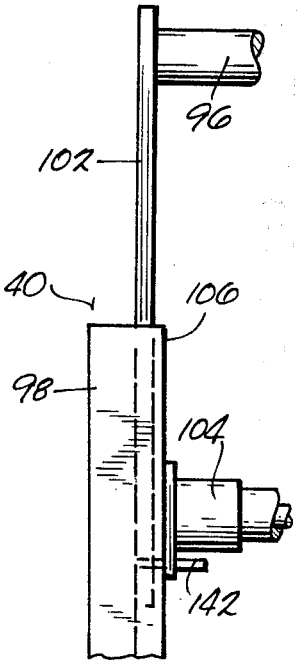
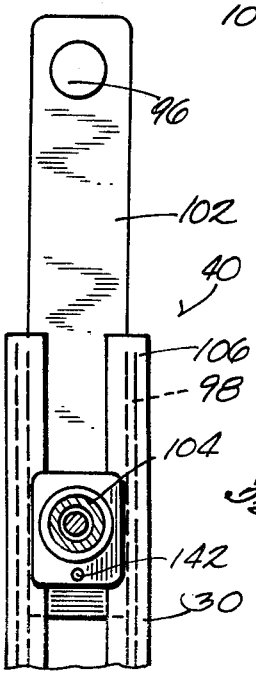
Fig. 6

DRAWING TABLE AND EASEL CONVERSION

TECHNICAL FIELD

The following invention relates to a folding table, particularly a table convertible to an easel.

BACKGROUND ART

The following patents show a table that can be inclined to a substantially vertical position, for use as an easel or otherwise: U.S. Pat. No. 511,466, issued to Selden on Dec. 26, 1893; U.S. Pat. No. 519,655, issued to Atzert on May 8, 1894; U.S. Pat. No. 677,216, issued to Huebner on June 25, 1901; U.S. Pat. No. 697,639, issued to Lindner on May 15, 1902; and U.S. Pat. No. 1,652,774, issued to Fraser et al. on Dec. 13, 1927. None of those patents shows the present structure to accomplish that end. U.S. Pat. No. 2,265,105, issued to Farrington on Dec. 2, 1941 is also pertinent because it shows turnbuckle operated brake means for an extendable leg or strut.

SUMMARY OF THE INVENTION

The invention is a folding table having crossed pairs of legs which unfold to a limit defined by a stop, forming a base. The tabletop is removable and has first and second opposed edges, respectively supported by the first and second legs in each crossed pair. The first edge of the table can be supported by a strut having one end pivotally attached to the first edge of the tabletop. The other end of the strut engages a first rack formed along an upper portion of one of the legs. The second edge of the tabletop can be supported by a second rack along its underside which engages a transverse bar secured to the base. The inclination of the tabletop can be changed by supporting the strut in a different notch of the first rack, by supporting the transverse bar in a different notch of the second rack, or both.

The tabletop can be tilted to a substantially vertical position and a suitable keeper and ledge can be provided, forming an easel. Tilting can be accomplished by various means or combinations of means. In one embodiment the strut supporting the first edge of the table telescopes, and when extended allows substantially vertical positioning of the tabletop. In another embodiment an intermediate stop is provided to allow the legs of the base to be pivotally positioned between their normal folded and unfolded positions. In a third embodiement, the transverse bar is supported by telescoping legs to allow adjustment of the inclination of the tabletop.

In a variation of the invention the tabletop can be replaced by a skeletonized easel frame, including a ledge which moves up and down against the easel frame on a rack and a keeper adjustable to different elevations above the frame to secure canvases of various sized to the easel.

Finally, means can be provided to secure a side table or a drawer box and drawer to the assembly to permit storage and support of drawing tools and supplies.

BRIEF DESCRIPTION OF DRAWINGS

FIG. 1 is a front elevation of the invention, with the tabletop cut away to show the structure supporting it.

FIGS. 5 and 6 are enlarged fragmentary elevations of the telescoping leg and transverse bar assembly of the invention.

FIG. 7 is a view taken along line 7—7 of FIG. 1, partly in elevation and partly in cross-section.

DESCRIPTION OF THE PREFERRED EMBODIMENTS

Although the disclosure hereof is detailed and exact to enable those skilled in the art to practice the invention, the physical embodiments herein disclosed merely exemplify the invention which may be embodied in other specific structure. While the best known embodiment has been described, the details may be changed without departing from the invention, which is defined by the claims.

Figure 4:
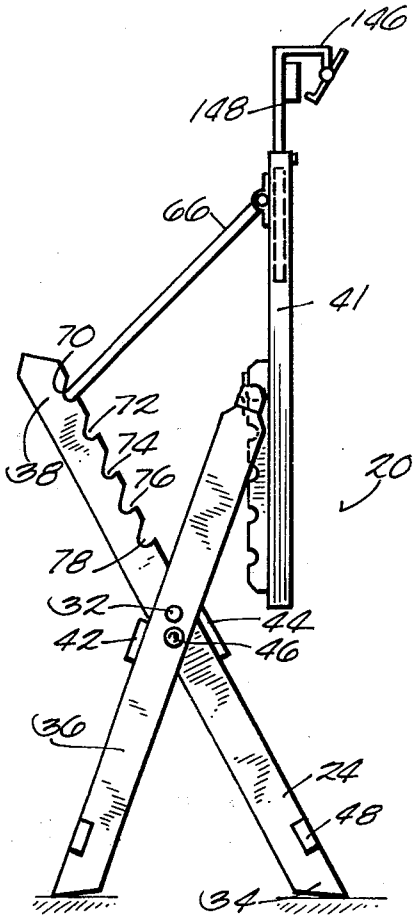
FIGS. 2, 3, and 4 are side elevations of the invention showing adjustment of the tabletop to horizontal, oblique, and vertical positions.

FIGS. 1 through 7 show the construction of one form of the invention, in which the table assembly 20 can be adjusted to provide a table having any inclination from a horizontal position (shown in FIG. 3) to an oblique position (shown in FIG. 2) to a substantially vertical position (shown in FIG. 4).

Figure 3:
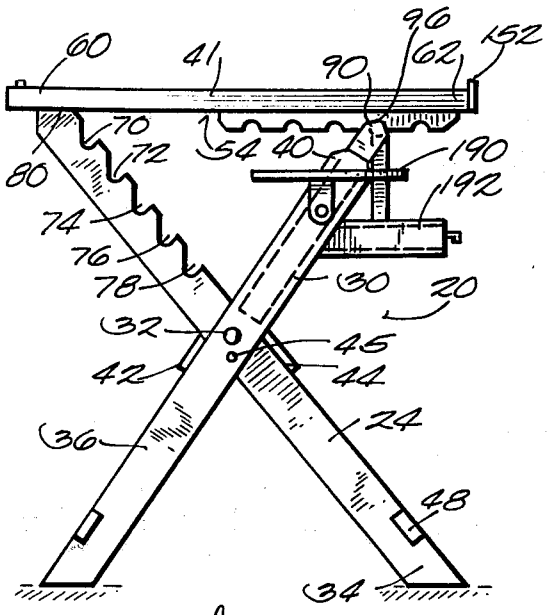
Figure 2:
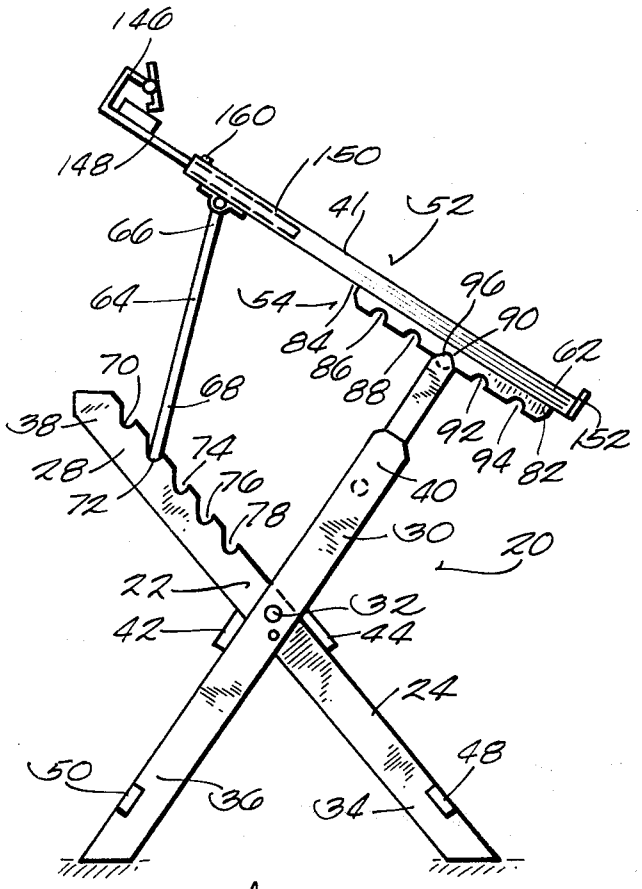
Figure 8:
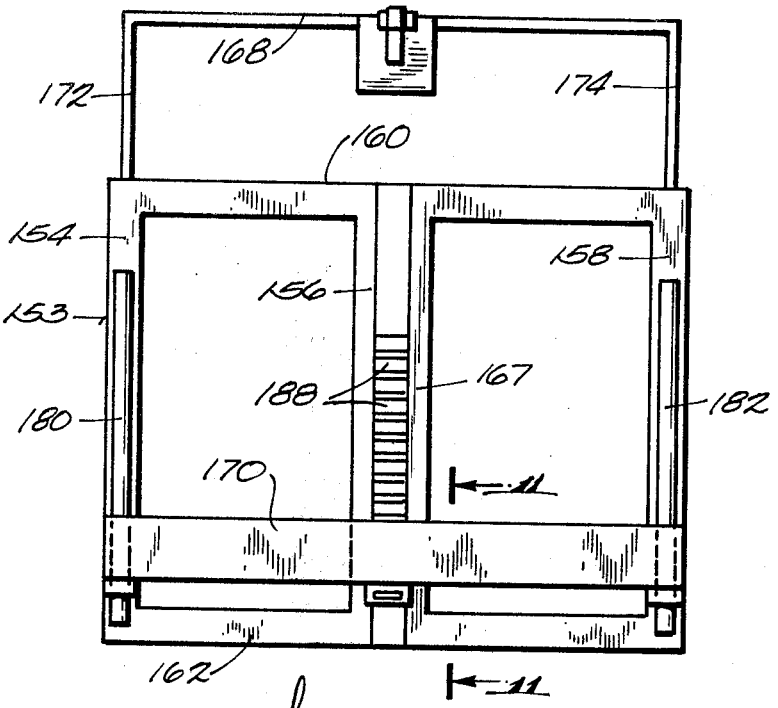
FIG. 8 is a front elevation of a skeletonized easel frame which can take the place of the tabletop shown in the previous Figures.
Figure 9:
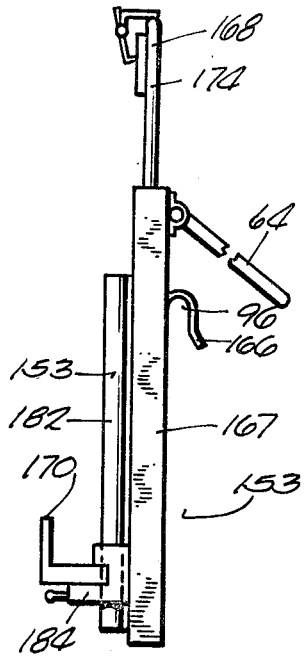
FIGS. 9 and 10 are respectively a side elevation and a plan view of the skeletonized easel frame of FIG. 8.
Figure 10:
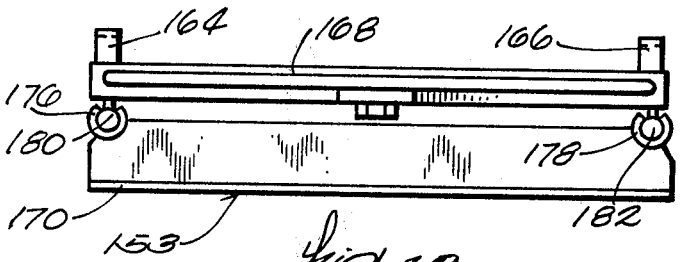
Figure 11:
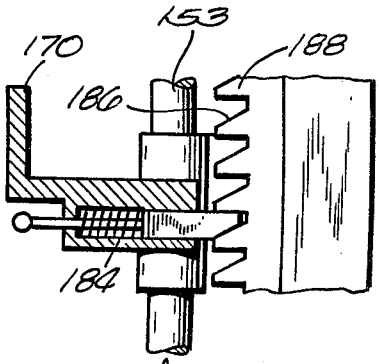
FIG. 11 is a cross-section taken along line 11—11 in FIG. 8, showing a rack and pawl mechanism to support the ledge at various elevations along the easel frame.

Referring particularly to FIGS. 1 and 2, table assembly 20 includes a folding base 22 having at least two pairs 24 and 26 of pivotally attached crossed legs. Pair 24, for example, comprises a first leg 28 and a second leg 30 joined by a pivot pin 32 and respectively having lower ends 34 and 36 to touch the ground and upper ends 38 and 40 which receive support means for tabletop 41. Legs 28 and 30 fold or unfold about pivot 32. The legs can be folded to be parallel for compact storage and can be unfolded to the extent allowed by stops 42 and 44. Thus, in the embodiment shown in FIG. 2 the legs unfold to a single, stable position which does not change as the table is adjusted. Alternately, as shown in FIGS. 3 and 4, intermediate stop means (here a pair of registered holes and a securing pin, respectively 45 and 46) can be provided to fix the legs with their tips higher and closer together than when stops 42 and 44 are engaged. As shown in FIG. 1, pairs of legs 24 and 26 are joined by transverse braces 48 and 50 and by stops 42 and 44 to provide a stable base.

Tabletop 41 has a top surface 52, a bottom surface 54, transversely separated sides 56 and 58 and opposed first and second edges 60 and 62. First edge 60 of the table top is supported by a strut 64 having one end 66 pivotally attached to bottom surface 54 of the tabletop. The other end 68 of the strut is received in one of the notches 70, 72, 74, 76, and 78 defining a first rack in the upper end 38 of first leg 28. As shown in FIG. 1, strut 64 can be transversely extended for added support by providing parallel strut members 64 and 79 joined by transversely extending upper end 66 pivotally secured to tabletop bottom surface 54 and transversely extending lower end 68 received in registered pairs of notches forming parallel first racks. FIG. 3 shows that when the tabletop 41 is to be horizontally disposed, strut 64 can be removed or folded out of the way, allowing a portion of bottom surface 54 adjacent first edge 60 to rest directly on the upper extremity 80 of first leg 28.

Second edge 62 of table top 41 is supported by a second rack 82 attached to bottom surface 54, extending from adjacent second edge 62 to a central portion 84 of the tabletop, and having notches 86, 88, 90, 92, and 94 formed therein to receive a transversely extending bar 96. By variously selecting the notches engaging transversely extending bar 96 and strut 64, the tabletop can be positioned at various heights above the floor and at various inclinations. The table can thus be used by a person who is standing or sitting, depending on how it is adjusted.

To provide further latitude for adjustment of the assembly, the upper end 40 of each second leg such as 30 can telescope and extend thereby moving transversely extending bar 96 obliquely up or down. The construction of the upper end 40 of each second leg such as 30 allowing such adjustment is best shown in FIGS. 5, 6, and 7. Each upper end 40 comprises a lower member 98 provided with a longitudinally extending channel 100 to receive upper member 102 for parallel sliding displacement. The previously described transversely extending bar 96 is carried at the upper ends of the upper members 102. Braking means 104 are provided for each leg assembly to secure or release upper members 102 in channels 100. The respective brakes 104, shown on the second leg of each pair of legs in FIG. 1, are positioned adjacent the inwardly opposed surfaces 106 of the second legs.

FIG. 7 shows the braking means 104 in more detail. Channel 100 is defined in part by a pair of lips 108 and 110 confining upper member 102 to sliding motion within channel 100. The lips have inner surfaces 112 for bearing against upper member 102 and outer surface 106 for being frictionally engaged by the brake mechanism. Upper members 102 are connected by a spacer bar 116 to prevent them from moving apart. A rotatable braking bar 128 is coaxially mounted on spacer bar 116 and has a threaded end 130 and an unthreaded end 132 respectively received in collars 134 and 136. Each collar has a pressure plate 138 which cooperates with the corresponding upper member 102 to form a pair of jaws between which lips 108 and 110 are sandwiched. Finally, pin 142 prevents rotation of collars 134 and 136 with respect to the corresponding upper members.

When braking bar 128 is rotated one way collar 134 is threadably advanced to the left with respect to bar 128, while end 132 bears against pressure plate 138. Pressure plates 138 then spread apart, pinching lips 108 and 110 against upper members 102 to simultaneously fix each upper member 102 with respect to its corresponding lower member 98. Spacer bar 116 prevents corresponding spreading of the upper members. When braking bar 128 is counterrotated, both brakes are released at once and the corresponding upper members 102 which carry transversely extending bar 96 are free to slide to raise or lower the transverse bar.

The embodiment of FIGS. 1 through 7 can also include a keeper 146 mounted on a sliding member 148 for sliding into or out of a channel 150, best seen in FIG. 2, formed within or attached to the back surface of tabletop 41. The keepr can be moved toward or away from tabletop 41 or removed from the tabletop entirely, depending on what is most practical at the moment. A removable or permanent ledge 152 can be attached to tabletop 41 opposite the keeper.

A separate tabletop which is readily adapted for use as an easel, as shown in FIGS. 8 through 11, can be provided for attachment to base 22 in place of tabletop 41 in an alternate embodiment of the invention. The easel body 153 shown in FIGS. 8–11 is skeletonized, and comprises vertically disposed parallel frame members 154, 156 and 158 joined by transversely extending frame member 160 and 162. Transversely spaced hooks 164 and 166 attached to the backs of frame members 154 and 158 engage the transversely extending bar 96 of the folding base 22 to support easel body 153. Hooks 164 and 166 can be mounted above the central portion 167 of the easel body 153 and the lower end of the easel body can rest against the lower portion of the legs of base 22, or a strut 64 can be provided to support the easel body 153.

In an especially preferred embodiment of the invention, a keeper 168 and ledge 170 are provided, each of sturdy construction to support a heavy canvas, and each vertically adjustable top position a canvas vertically according to the need of the moment. Keeper 168 has two legs, 172 and 174, which are slidable within frame members 154 and 158 (much like the keeper shown in FIG. 2). Ledge 170 has runners 176 and 178 which slide on tubular tracks 180 and 182 for vertical positioning of the ledge. When the ledge is appropriately situated on tracks 180 and 182 it can be secured against vertical movement by the spring-loaded pawl mechanism 184 which engages a desired notch such as 186 in the vertically disposed third rack 188. Since both the ledge and the keeper are vertically adjustable there is no need to provide vertical adjustment of the easel body itself. Such adjustment, however, is not beyond the scope of the invention.

Figure 12:
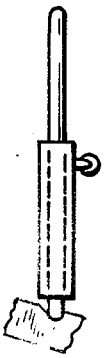
FIG. 12 shows a telescoping version of the strut 64 shown in FIGS. 2 and 4.

FIG. 12 shows an alternate embodiment of strut 64 which telescopes to permit even further adjustability of the table assembly.

FIG. 3 shows a side table assembly 190 for attachment to the upper end 40 of leg 30. FIG. 3 also shows a drawer box and drawer assembly 192 which can be hung from transversely extending bar 96 to clear the lower portion of second edge 62 of the table, allowing the storage of various instruments and supplies to be used on the table or easel.

One advantage of the present invention is the provision of a stable yet folding base which can remain in a single position or at most two positions despite all the possible changes in elevation and inclination of the drawing table or easel supported thereon.

I claim:

1. A folding table comprising:

A. at least two pairs of first and second pivotally attached crossed legs, joined by transverse brace members to form a folding base;

B. stop means defining the limit of unfolding of said base;

C. a removable tabletop having a top surface, a bottom surface, first and second opposed edges, and a central portion between said edges;

D. first rack means extending along the upper ends of said first legs;

E. a strut having one end pivotally attached to said tabletop bottom surface near said first edge and the other end received by said first rack means to support said first edge;

F. second rack means extending along the bottom surface of said tabletop substantially from said second edge to said central portion; and G. a transversely extending bar supported by the upper ends of said second legs and received by said second rack means to support said econd edge.

2. The folding table of claim 1, wherein said strut telescopes, whereby to change the elevation of the first edge of said tabletop while said base remains unfolded to its limit of unfolding.

3. The folding table of claim 1, wherein said second legs telescope, whereby to change the elevation of the second edge of said tabletop while said base remains unfolded to said limit.

4. The folding table of claim 3, wherein said telescoping second legs further comprise lower members provided with longitudinal channels, upper members received in said channels for parallel sliding displacement and supporting said transversely extending bar, and brake means releasably fixing said upper and lower members together.

5. The folding table of claim 4, wherein said brake means comprises:

A. a pair of lips on each lower member confining each upper member in its channel, each said pair of lips having inner surfaces for being borne against by said upper members and opposed outer surfaces, the outer surfaces of the respective pairs of lips being inwardly opposed;

B. a spacer bar having its respective ends attached to said upper members near their lower ends;

C. a pressure plate for each upper member having an outer face for bearing against the outer surfaces of said pair of lips and a collar perpendicular to said outer face bored to receive said spacer bar therethrough;

D. a tubular release bar carried on said spacer bar and having a first end threadably received by one said collar and a second end bearing against the opposite pressure plate and received in the corresponding collar; and E. means to prevent said pressure plates from rotating with respect to said upper members; whereby rotation of said release bar urges said pressure plates and upper members together against said pairs of lips to fix said upper members and lower members together, and whereby counterrotation of said release bar releases said upper members for sliding displacement relative to said lower members.

6. The folding table of claim 1, wherein said tabletop can be raised to a substantially vertical position for use of said folding table as an easel.

7. The folding table of claim 6, further comprising removable intermediate stop means to fix said crossed legs in a position between their fully folded and fully unfolded positions.

8. The folding table of claim 6, further comprising ledge means for mounting adjacent one of said first and second edges and keeper means for mounting adjacent the other of said first and second edges.

9. The folding table of claim 8, wherein said keeper means can be removed from said tabletop when not in use.

10. The folding table of claim 8, wherein said keeper means is mounted on a slide received in a track fixed to the bottom surface of said tabletop, whereby to support said keeper at various points beyond the edge of said tabletop.

11. The folding table of claim 8, wherein said ledge is slidable up or down along said tabletop.

12. The folding table of claim 11, wherein said tabletop top surface includes a third rack disposed in the direction of travel of said ledge and support means to support said ledge at a desired position along said third rack.

13. The folding table of claim 1, further comprising a side table fixed to an upper portion of one of said legs.

14. The folding table of claim 1, further comprising a draw box and drawer assembly and means supporting said assembly from said transversely extending bar for access from beneath said tabletop.

15. An easel comprising:

A. at least two pairs of first and second pivotally attached crossed legs, joined by transverse brace members to form a folding base;

B. stop means defining the limit of unfolding of said base;

C. a removable easel body having a top surface, a bottom surface, first and second opposed edges, and a central portion between said edges;

D. a transversely extending bar supported by the upper ends of said second legs;

E. means mounted to said easel body bottom surface between said central portion and said first edge to engage said transversely extending bar;

F. means to support said second edge against the lower ends of said first legs; and G. table support means positioned substantially adjacent said first and second edges to receive the tops of said first and second legs when said easel body is supported substantially horizontally thereon, wherein said table support means includes:

first rack means extending along the upper ends of said first legs;

a strut having one end pivotally attached to said easel body bottom surface near said first edge and the other end received by said first rack means to support said first edge; and second rack means extending along the bottom surface of said easel body substantially from said second edge to said central portion, adapted to engage said transversely extending bar to support said second edge; whereby to support said easel body for use as a tabletop.

* * * * *

UNITED STATES PATENT AND TRADEMARK OFFICE

CERTIFICATE OF CORRECTION

PATENT NO. : 4,404,914

DATED : September 20, 1983

INVENTOR(S) : Max F. Taylor

It is certified that error appears in the above-identified patent and that said Letters Patent is hereby corrected as shown below:

Claim 14, Column 6, line 21, "draw" should read -- drawer --.

Signed and Sealed this

Ninth Day of October 1984

[SEAL]

*Attest:*

GERALD J. MOSSINGHOFF

*Attesting Officer*

*Commissioner of Patents and Trademarks*